US010902779B2

(12) United States Patent
Li et al.

(10) Patent No.: US 10,902,779 B2
(45) Date of Patent: Jan. 26, 2021

(54) PIXEL CIRCUIT, METHOD FOR DRIVING THE SAME, DISPLAY PANEL AND DISPLAY DEVICE

(71) Applicants: Chengdu BOE Optoelectronics Technology Co., Ltd., Chengdu (CN); BOE Technology Group Co., Ltd., Beijing (CN)

(72) Inventors: Qian Li, Beijing (CN); Bing Zhang, Beijing (CN)

(73) Assignees: Chengdu BOE Optoelectronics Technology Co., Ltd., Chengdu (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/391,780

(22) Filed: Apr. 23, 2019

(65) Prior Publication Data

US 2020/0074928 A1 Mar. 5, 2020

(30) Foreign Application Priority Data

Aug. 30, 2018 (CN) ..... 2018 1 1003451

(51) Int. Cl.
*G09G 3/3258* (2016.01)

(52) U.S. Cl.
CPC ..... *G09G 3/3258* (2013.01); *G09G 2320/045* (2013.01)

(58) Field of Classification Search
CPC ..... G09G 3/3258; G09G 2320/045
See application file for complete search history.

(56) References Cited

U.S. PATENT DOCUMENTS

2014/0320550 A1* 10/2014 Liao ..... G09G 3/3225 345/690
2017/0162118 A1* 6/2017 Liu ..... G09G 3/3241
(Continued)

FOREIGN PATENT DOCUMENTS

CN 102222468 A 10/2011
CN 202110796 U 1/2012
(Continued)

OTHER PUBLICATIONS

Chinese Office Action dated Oct. 28, 2019 issued in related Chinese Application No. 201811003451.5.

*Primary Examiner* — Sahlu Okebato
(74) *Attorney, Agent, or Firm* — Arent Fox LLP; Michael Fainberg

(57) ABSTRACT

A pixel circuit, a method for driving the same, a display panel and a display device are provided. The pixel circuit includes: a resetting sub-circuit, a data writing sub-circuit, a driving sub-circuit, a first light-emission controlling sub-circuit, a second light-emission controlling sub-circuit, an anode potential controlling sub-circuit, a capacitor sub-circuit, and a light-emitting element, all of which operate in cooperation so that the pixel circuit drives the light-emitting element to emit light, where the second light-emission controlling sub-circuit provides voltage at an output terminal of the driving sub-circuit to an anode of the light-emitting element in a light-emission period, and the anode potential controlling sub-circuit provides a signal of a first voltage signal terminal to the anode of the light-emitting element in a non-light-emission period.

14 Claims, 7 Drawing Sheets

(56) References Cited

U.S. PATENT DOCUMENTS

| | | | | |
|---|---|---|---|---|
| 2018/0130410 | A1* | 5/2018 | Gao | G09G 3/3225 |
| 2018/0151123 | A1* | 5/2018 | Li | H01L 51/5203 |
| 2019/0096327 | A1 | 3/2019 | Peng et al. | |

FOREIGN PATENT DOCUMENTS

| | | | |
|---|---|---|---|
| CN | 103021336 | A | 4/2013 |
| CN | 203085133 | U | 7/2013 |
| CN | 107610652 | A | 1/2018 |

* cited by examiner

PIXEL CIRCUIT, METHOD FOR DRIVING THE SAME, DISPLAY PANEL AND DISPLAY DEVICE

CROSS-REFERENCES TO RELATED APPLICATIONS

This application claims priority to Chinese patent application No. 201811003451.5 filed on Aug. 30, 2018, which is incorporated herein by reference in its entirety.

FIELD

The present disclosure relates to the field of display technologies, and particularly to a pixel circuit, a method for driving the same, a display panel and a display device.

BACKGROUND

An Organic Light-Emitting Diode (OLED) display is one of focuses in the research field of displays, and since the OLED display has low power consumption, a low production cost, self-emission, a wide angle of view, a high response speed, and other advantages over a Liquid Crystal Display (LCD), the OLED display has come to take the place of the traditional LCD in the field of mobile phones, Personal Digital Assistants (PDAs), digital cameras, and other displays. The design of a pixel circuit is a core technology in the OLED display, and a research thereon is of significance.

SUMMARY

In one aspect, an embodiment of the disclosure provides a pixel circuit. The pixel circuit includes: a resetting sub-circuit, a data writing sub-circuit, a driving sub-circuit, a first light-emission controlling sub-circuit, a second light-emission controlling sub-circuit, an anode potential controlling sub-circuit, a capacitor sub-circuit, and a light-emitting element. The resetting sub-circuit is configured to provide a signal of a first voltage signal terminal to a control terminal of the driving sub-circuit under the control of a reset signal terminal; the data writing sub-circuit is configured to provide a data signal transmitted from a data signal terminal to the driving sub-circuit under the control of a scan signal terminal; the driving sub-circuit is configured to drive the light-emitting element to emit light, under the control of the potential at an output terminal of the resetting sub-circuit; the first light-emission controlling sub-circuit is configured to provide a signal of a second voltage signal terminal to the driving sub-circuit under the control of a first control terminal; the capacitor sub-circuit is configured to maintain a stable voltage difference between the second voltage signal terminal and the control terminal of the driving sub-circuit; the second light-emission controlling sub-circuit is configured to provide voltage at an output terminal of the driving sub-circuit to an anode of the light-emitting element under the control of the first control terminal; and the anode potential controlling sub-circuit is configured to provide the signal of the first voltage signal terminal to the anode of the light-emitting element under the control of the second control terminal; wherein in a light-emission period, the second light-emission controlling sub-circuit provides the voltage at the output terminal of the driving sub-circuit to the anode of the light-emitting element, and in a non-light-emission period, the anode potential controlling sub-circuit provides the signal of the first voltage signal terminal to the anode of the light-emitting element.

In a possible implementation, in the pixel circuit above according to the embodiment of the disclosure, the resetting sub-circuit includes a first transistor. The first transistor has a gate connected with the reset signal terminal, a first electrode connected with the first voltage signal terminal, and a second electrode connected with the control terminal of the driving sub-circuit.

In a possible implementation, in the pixel circuit above according to the embodiment of the disclosure, the driving sub-circuit includes: a driver transistor and a second transistor. The driver transistor has a gate connected with the output terminal of the resetting sub-circuit, a first electrode connected with an output terminal of the first light-emission controlling sub-circuit, and a second electrode connected with an input terminal of the second light-emission controlling sub-circuit; and the second transistor has a gate connected with the scan signal terminal, a first electrode connected with the output terminal of the reset sub-circuit, and a second electrode connected with the input terminal of the second light-emission controlling sub-circuit.

In a possible implementation, in the pixel circuit above according to the embodiment of the disclosure, the data writing sub-circuit includes a third transistor. The third transistor has a gate connected with the scan signal terminal, a first electrode connected with the data signal terminal, and a second electrode connected with the input terminal of the driving sub-circuit.

In a possible implementation, in the pixel circuit above according to the embodiment of the disclosure, the data writing sub-circuit includes a third transistor. The third transistor has a gate connected with the scan signal terminal, a first electrode connected with the data signal terminal, and a second electrode connected with the control terminal of the driving sub-circuit.

In a possible implementation, in the pixel circuit above according to the embodiment of the disclosure, the first light-emission controlling sub-circuit includes a fourth transistor. The fourth transistor has a gate connected with the first control terminal, a first electrode connected with the second voltage signal terminal, and a second electrode connected with the input terminal of the driving sub-circuit.

In a possible implementation, in the pixel circuit above according to the embodiment of the disclosure, the second light-emission controlling sub-circuit includes a fifth transistor. The fifth transistor has a gate connected with the first control terminal, a first electrode connected with the output terminal of the driving sub-circuit, and a second electrode connected with the anode of the light-emitting element.

In a possible implementation, in the pixel circuit above according to the embodiment of the disclosure, the anode potential controlling sub-circuit includes a sixth transistor. The sixth transistor has a gate connected with the second control terminal, a first electrode connected with the first voltage signal terminal, and a second electrode connected with the anode of the light-emitting element.

In a possible implementation, in the pixel circuit above according to the embodiment of the disclosure, the capacitor sub-circuit includes a first capacitor. The first capacitor has one terminal connected with the second voltage signal terminal, and the other terminal connected with the control terminal of the driving sub-circuit.

In a possible implementation, in the pixel circuit above according to the embodiment of the disclosure, the signal of the first control terminal and the signal of the second control terminal are signals with adjustable duty cycles.

In a possible implementation, in the pixel circuit above according to the embodiment of the disclosure, all the transistors are N-type transistors, or all the transistors are P-type transistors.

In another aspect, an embodiment of the disclosure further provides a method for driving the pixel circuit above. The method includes: in a reset period, providing, by the resetting sub-circuit, the signal of the first voltage signal terminal to the driving sub-circuit under the control of the reset signal terminal, and providing, by the anode potential controlling sub-circuit, the signal of the first voltage signal terminal to the anode of the light-emitting element under the control of the second control terminal; in a data writing period, providing, by the data writing sub-circuit, the signal of the data signal terminal to the driving sub-circuit under the control of the scan signal terminal, maintaining, by the capacitor sub-circuit, a stable voltage difference between the control terminal of the driving sub-circuit and the second voltage signal terminal, and providing, by the anode potential controlling sub-circuit, the signal of the first voltage signal terminal to the anode of the light-emitting element under the control of the second control terminal; and in a light-emission period, providing, by the first light-emission controlling sub-circuit, the signal of the second voltage signal terminal to the driving sub-circuit under the control of the first control terminal, maintaining, by the capacitor sub-circuit, a stable voltage difference between the control terminal of the driving sub-circuit and the second voltage signal terminal, to control the driving sub-circuit to provide a driving signal to the second light-emission controlling sub-circuit; and providing, by the second light-emission controlling sub-circuit, the potential at the output terminal of the driving sub-circuit to the anode of the light-emitting element under the control of the first control terminal.

In a possible implementation, in the method above for driving the pixel circuit according to the embodiment of the disclosure, in the light-emission period, the signal of the first control terminal and the signal of the second control terminal are signals with adjustable duty cycles.

In another aspect, an embodiment of the disclosure further provides a light-emitting diode display panel including a plurality of pixel circuits above according to the embodiment of the disclosure, which are arranged in a matrix.

In another aspect, an embodiment of the disclosure further provides a display device including the light-emitting diode display panel above according to the embodiment of the disclosure.

DETAILED DESCRIPTION

In order to drive an OLED to emit light in the related art, the OLED shall be applied by forward-bias to drive the OLED to emit light, so that the OLED remains in one bias state all the time, and thus ions may be gathered in the OLED, and a built-in electric field may be formed in the OLED to offset the bias, so voltage may rise over time. Since the ions are gathered in the OLED, excitons may be quenched, so that the light-emission efficiency and the lifetime of the OLED may be degraded more quickly.

Accordingly it is highly desirable for those skilled in the art to improve the light-emission efficiency and the lifetime of the OLED.

Embodiments of the disclosure provide a pixel circuit, a method for driving the same, a display panel, and a display device so as to improve the light-emission efficiency and the lifetime of a light-emitting element.

Implementations of a pixel circuit, a method for driving the same, a display panel, and a display device according to embodiments of the disclosure will be described below in details with reference to the drawings.

Figure 1:
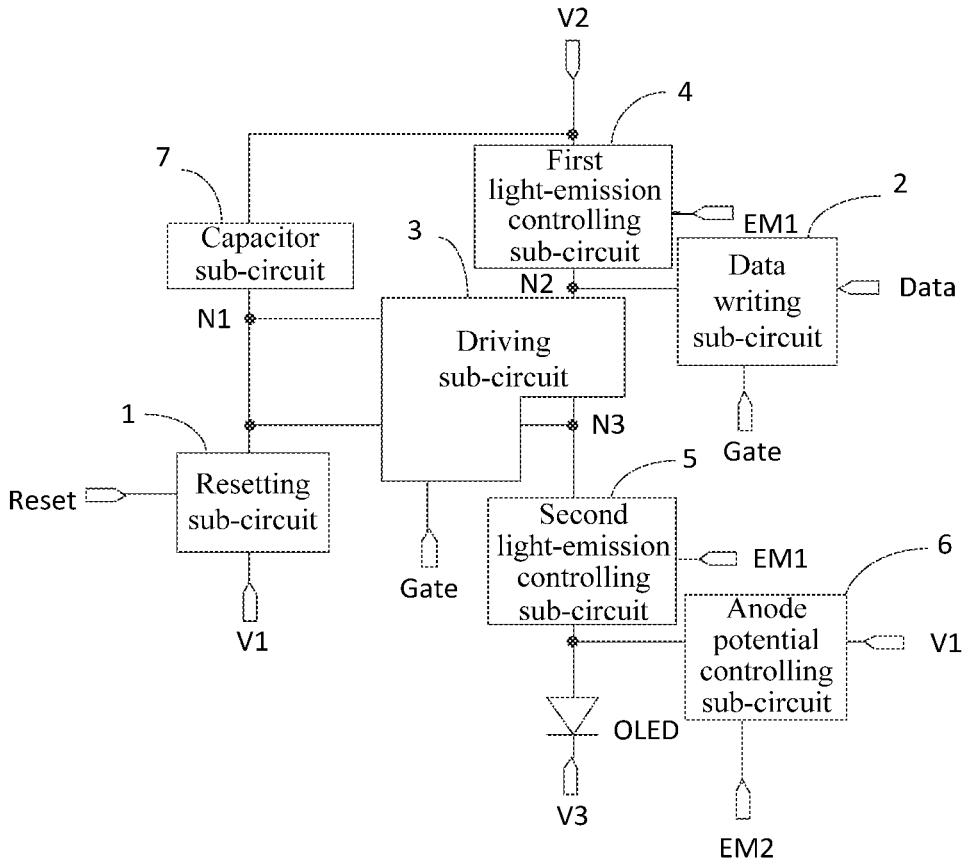
FIG. 1 is a first schematic structural diagram of a pixel circuit according to an embodiment of the disclosure.
Figure 2:
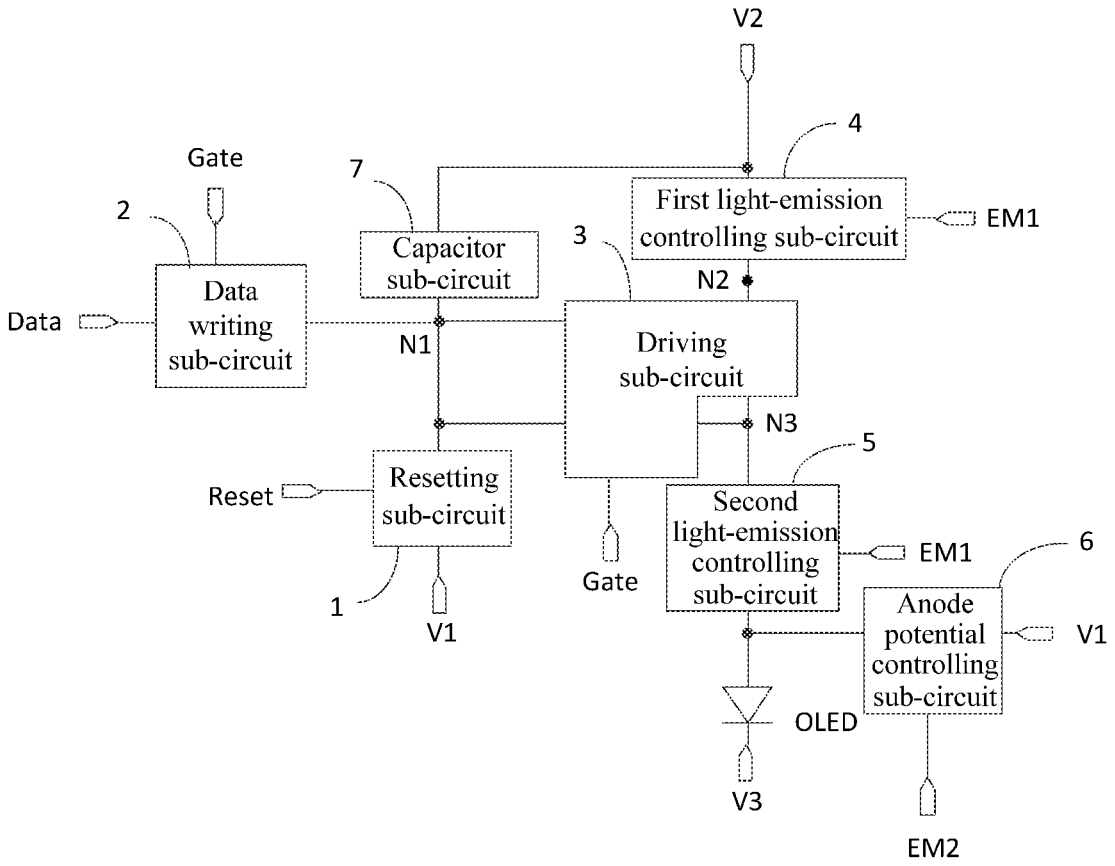
FIG. 2 is a second schematic structural diagram of the pixel circuit according to the embodiment of the disclosure.

As illustrated in FIG. 1 and FIG. 2, a pixel circuit according to an embodiment of the disclosure includes: a resetting sub-circuit 1, a data writing sub-circuit 2, a driving sub-circuit 3, a first light-emission controlling sub-circuit 4, a second light-emission controlling sub-circuit 5, an anode potential controlling sub-circuit 6, a capacitor sub-circuit 7, and a light-emitting element OLED.

The resetting sub-circuit 1 is configured to provide a signal of a first voltage signal terminal V1 to a control terminal of the driving sub-circuit 3 under the control of a reset signal terminal Reset.

The data writing sub-circuit 2 is configured to provide a data signal transmitted from a data signal terminal Data to the driving sub-circuit 3 under the control of a scan signal terminal Gate.

The driving sub-circuit 3 is configured to drive the light-emitting element OLED to emit light, under the control of the potential at an output terminal of the resetting sub-circuit 1.

The capacitor sub-circuit 7 is configured to maintain a stable voltage difference between the second voltage signal terminal V2 and the control terminal of the driving sub-circuit 3.

The first light-emission controlling sub-circuit 4 is configured to provide a signal of a second voltage signal terminal V2 to the driving sub-circuit 3 under the control of a first control terminal EM1.

The second light-emission controlling sub-circuit 5 is configured to provide voltage at an output terminal of the driving sub-circuit 3 to an anode of the light-emitting element OLED under the control of the first control terminal EM1.

The anode potential controlling sub-circuit 6 is configured to provide the signal of the first voltage signal terminal V1 to the anode of the light-emitting element OLED under the control of the second control terminal EM2.

In a light-emission period, the second light-emission controlling sub-circuit 5 provides the voltage at the output terminal of the driving sub-circuit 3 to the anode of the light-emitting element OLED, and in a non-light-emission period, the anode potential controlling sub-circuit 6 provides the signal of the first voltage signal terminal V1 to the anode of the light-emitting element OLED.

Specifically in the pixel circuit above according to the embodiment of the disclosure, the light-emission efficiency and the service lifetime of the light-emitting element were tested using a direct-current signal DC, an AC pulse signal, and a PC pulse signal respectively, where the light-emitting element emits light intermittently due to the AC pulse signal, and the current is zero, and the voltage is negative in an interval of time between two instances of valid pulse current; and the light-emitting element emits light due to the PC pulse signal, and the current is zero, and the voltage is positive in an interval of time between two instances of valid pulse current. The test showed that when data luminance of the light-emitting element dropped to 70% after it had operated for a period of time, the length of the service lifetime of the light-emitting element driven using the PC pulse signal was twice the length of the service lifetime of the light-emitting element driven using the direct-current signal DC, and the length of the service lifetime of the light-emitting element driven using the AC pulse signal was twice the length of the service lifetime of the light-emitting element driven using the PC pulse signal. Apparently when the light-emitting element is driven using the AC pulse signal, the ions can be avoided from being aggregated in the light-emitting element, to thereby improve the service lifetime of the light-emitting element.

Accordingly the pixel circuit above according to the embodiment of the disclosure includes: a resetting sub-circuit, a data writing sub-circuit, a driving sub-circuit, a first light-emission controlling sub-circuit, a second light-emission controlling sub-circuit, an anode potential controlling sub-circuit, a capacitor sub-circuit, and a light-emitting element. The above sub-circuits can operate in cooperation so that the pixel circuit drives the light-emitting element to emit light, where the second light-emission controlling sub-circuit provides voltage at an output terminal of the driving sub-circuit to an anode of the light-emitting element in a light-emission period, and the anode potential controlling sub-circuit provides a signal of a first voltage signal terminal to the anode of the light-emitting element in non-light-emission period, so that the bias of the light-emitting element in the non-light-emission period is opposite to the bias of the light-emitting element in the light-emission period, to thereby avoid ions from being aggregated in the light-emitting element so as to improve the light-emission efficiency and the service lifetime of the light-emitting element.

It shall be noted that in the pixel circuit above according to the embodiment of the disclosure, when both the second light-emission controlling sub-circuit and the anode potential controlling sub-circuit include the same type of transistors, the signal of the second control terminal can be made opposite in phase to the signal of the first control terminal all the time so that the second light-emission controlling sub-circuit provides the voltage at the output terminal of the driving sub-circuit to the anode of the light-emitting element in the light-emission period, and the anode potential controlling sub-circuit provides the signal of the first voltage signal terminal to the anode of the light-emitting element in the non-light-emission period. Of course, when both the second light-emission controlling sub-circuit and the anode potential controlling sub-circuit include different types of transistors, the second light-emission controlling sub-circuit and the anode potential controlling sub-circuit can be controlled using the same control terminal so that the second light-emission controlling sub-circuit provides the voltage at the output terminal of the driving sub-circuit to the anode of the light-emitting element in the light-emission period. The two implementations above can be selected as needed in reality, although the embodiment of the disclosure will not be limited thereto.

Specifically in the pixel circuit above according to the embodiment of the disclosure, when the signal of the second control terminal is opposite in phase to the signal of the first control terminal all the time, the second control terminal can be arranged as a separate signal terminal to provide the signal opposite in phase to the signal of the first control terminal, or the second control terminal can be the first control terminal to which an inverter is added to invert the phase of the output signal of the first control terminal, specifically as needed in reality, although the embodiment of the disclosure will not be limited thereto.

The voltage at the third voltage signal terminal is lower than the voltage of the second voltage signal terminal, so that the light-emitting element is forward-biased in the light-emission period; or the voltage at the first voltage signal terminal is lower than the voltage at the third voltage signal terminal, so that the light-emitting element is reverse-biased in the non-light-emission period, thus avoiding ions from being aggregated in the light-emitting element.

Specifically in the pixel circuit above according to the embodiment of the disclosure, as illustrated in FIG. 1, the output terminal of the data writing sub-circuit 2 can be connected with the second node N2, that is, the output terminal of the data writing sub-circuit 2 is connected with the input terminal of the driving sub-circuit 3 to thereby write data. Alternatively, as illustrated in FIG. 2, the output terminal of the data writing sub-circuit 2 is connected with the first node N1, that is, the output terminal of the data writing sub-circuit 2 is connected with the control terminal of the driving sub-circuit 3, to thereby write data. Data can be written in both of the two implementations above, and one of them can be selected as needed in reality, although the embodiment of the disclosure will not be limited thereto.

The disclosure will be described below in details in connection with a specific embodiment. It shall be noted that this embodiment is intended to better explain the disclosure, but not to limit the disclosure thereto.

Figure 3:
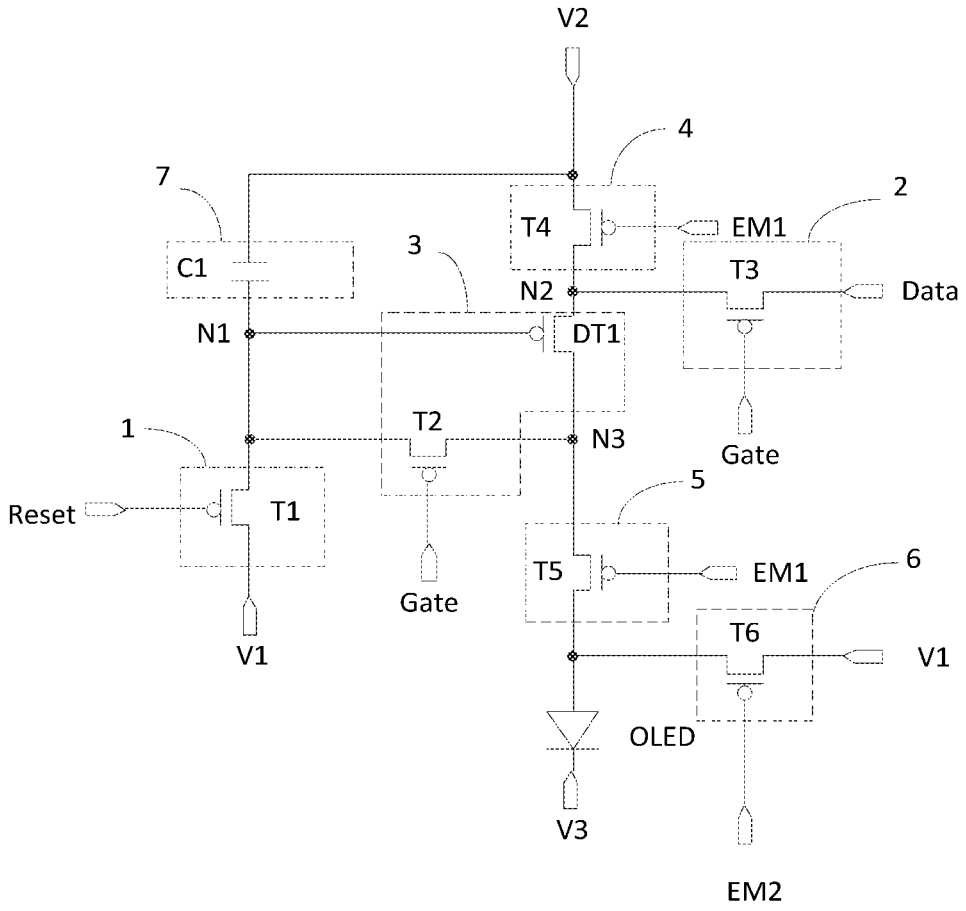
FIG. 3 is a schematic structural diagram in details of the pixel circuit in FIG. 1.
Figure 4:
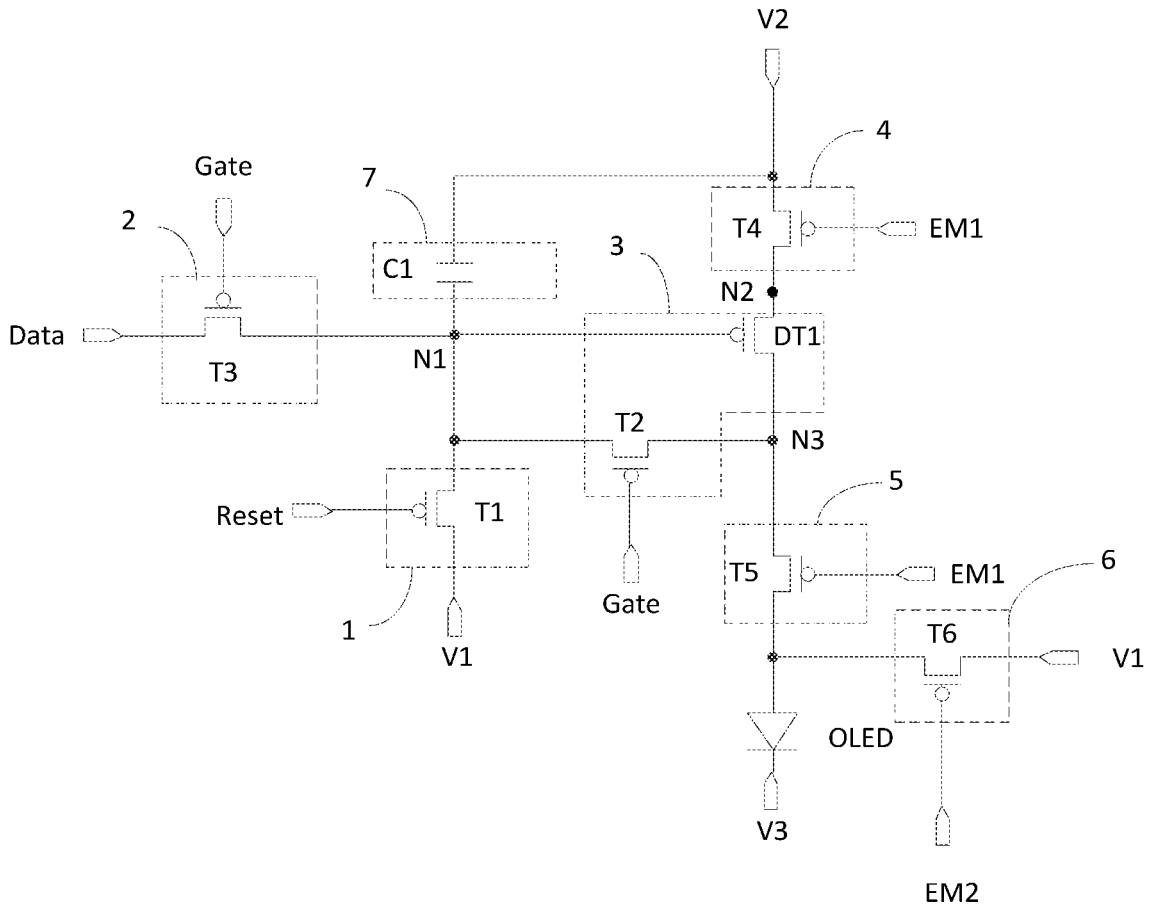
FIG. 4 is a schematic structural diagram in details of the pixel circuit in FIG. 2.

In some embodiments of the disclosure, in the pixel circuit above, as illustrated in FIG. 3 and FIG. 4, the resetting sub-circuit 1 includes a first transistor T1.

The first transistor T1 has a gate connected with the reset signal terminal Reset, a first electrode connected with the first voltage signal terminal V1, and a second electrode connected with the control terminal of the driving sub-circuit 3.

Furthermore in a specific implementation, as illustrated in FIG. 3 and FIG. 4, the first transistor T1 can be a P-type transistor. In this way, the first transistor T1 is turned on when a reset signal provided by the reset signal terminal Reset is at a low level, and turned off when the reset signal provided by the reset signal terminal Reset is at a high level. Or the first transistor T1 can be an N-type transistor (not illustrated), and in this way, the first transistor T1 is turned on when the reset signal provided by the reset signal terminal Reset is at a high level, and turned off when the reset signal provided by the reset signal terminal Reset is at a low level, although the embodiment of the disclosure will not be limited thereto.

In the pixel circuit above according to the embodiment of the disclosure, when the first transistor is turned on under the control of the reset signal terminal, the signal provided by the first voltage signal terminal is transmitted to the control terminal of the driving sub-circuit through the turned-on first transistor, to thereby reset the voltage at the control terminal of the driving sub-circuit.

A specific structure of the resetting sub-circuit in the pixel circuit has been described above only by way of an example, and in a specific implementation, the structure of the resetting sub-circuit will not be limited to the structure above according to the embodiment of the disclosure, but can alternatively be another structure which can occur to those skilled in the art, and the embodiment of the disclosure will not be limited thereto.

In some embodiments of the disclosure, in the pixel circuit above, as illustrated in FIG. 3 and FIG. 4, the driving sub-circuit 3 includes: a driver transistor DT1 and a second transistor T2.

The driver transistor DT1 has a gate connected with the output terminal of the resetting sub-circuit 1, a first electrode connected with the output terminal of the first light-emission controlling sub-circuit 4, and a second electrode connected with the input terminal of the second light-emission controlling sub-circuit 5.

The second transistor T2 has a gate connected with the scan signal terminal Gate, a first electrode connected with the output terminal of the reset sub-circuit 1, and a second electrode connected with the input terminal of the second light-emission controlling sub-circuit 5.

Specifically in the pixel circuit above according to the embodiment of the disclosure, the driver transistor DT1 can be a P-type transistor or an N-type transistor. In order to enable the driver transistor DT1 to operate normally, the voltage at the second voltage signal terminal V2 is generally positive, and the voltage at the third voltage signal terminal V3 is generally ground or negative.

As illustrated in FIG. 3 and FIG. 4, the second transistor T2 can be a P-type transistor, and in this way, the second transistor T2 is turned on when a scan signal provided by the scan signal terminal Gate is at a low level, and turned off when a scan signal provided by the scan signal terminal Gate is at a high level; or the second transistor T2 can be an N-type transistor (not illustrated), and in this way, the second transistor T2 is turned on when the scan signal provided by the scan signal terminal Gate is at a high level, and turned off when the scan signal provided by the scan signal terminal Gate is at a low level.

In the pixel circuit above according to the embodiment of the disclosure, when the second transistor is turned on under the control of the scan signal terminal, the signal of the output terminal of the resetting sub-circuit is provided to the second light-emission controlling sub-circuit through the turned-on second transistor.

A specific structure of the driving sub-circuit in the pixel circuit has been described above only by way of an example, and in a specific implementation, the specific structure of the driving sub-circuit will not be limited to the structure above according to the embodiment of the disclosure, but can alternatively be another structure which can occur to those skilled in the art, and the embodiment of the disclosure will not be limited thereto.

In some embodiments of the disclosure, in the pixel circuit above, as illustrated in FIG. 3 and FIG. 4, the data writing sub-circuit 2 includes a third transistor T3.

In some embodiments, as illustrated in FIG. 3, the third transistor T3 has a gate connected with the scan signal terminal Gate, a first electrode connected with the data signal terminal Data, and a second electrode connected with the input terminal of the driving sub-circuit 3.

In some other embodiments, as illustrated in FIG. 4, the third transistor T3 has a gate connected with the scan signal terminal Gate, a first electrode connected with the data signal terminal Data, and a second electrode connected with the input terminal of the driving sub-circuit 3.

Furthermore in a specific implementation, as illustrated in FIG. 3 and FIG. 4, the third transistor T3 can be a P-type transistor, and in this way, the third transistor T3 is turned on when the scan signal provided by the scan signal terminal Gate is at a low level, and turned off when the scan signal provided by the scan signal terminal Gate is at a high level; or the third transistor T3 can be an N-type transistor (not illustrated), and in this way, the third transistor T3 is turned on when the scan signal provided by the scan signal terminal Gate is at a high level, and turned off when the scan signal provided by the scan signal terminal Gate is at a low level.

In the pixel circuit above according to the embodiment of the disclosure, when the third transistor is turned on under the control of the scan signal terminal, the signal provided by the data signal terminal is transmitted to the control terminal (the first node N1) of the driving sub-circuit, or an input terminal (the second node N2) of the driving sub-circuit through the turned-on third transistor, to thereby write data.

A specific structure of the data writing sub-circuit in the pixel circuit has been described above only by way of an example, and in a specific implementation, the specific structure of the data writing sub-circuit will not be limited to the structure above according to the embodiment of the disclosure, but can alternatively be another structure which can occur to those skilled in the art, and the embodiment of the disclosure will not be limited thereto.

In some embodiments of the disclosure, in the pixel circuit above, as illustrated in FIG. 3 and FIG. 4, the first light-emission controlling sub-circuit 4 includes a fourth transistor T4.

The fourth transistor T4 has a gate connected with the first control terminal EM1, a first electrode connected with the second voltage signal terminal V2, and a second electrode connected with the input terminal of the driving sub-circuit 3.

In a specific implementation, as illustrated in FIG. 3 and FIG. 4, the fourth transistor T4 can be a P-type transistor, and in this way, the fourth transistor T4 is turned on when a first control signal provided by the first control terminal EM1 is at a low level, and turned off when the first control signal provided by the first control terminal EM1 is at a high level; or the fourth transistor T4 can be an N-type transistor (not illustrated), and in this way, the fourth transistor T4 is turned on when the first control signal provided by the first control terminal EM1 is at a high level, and turned off when the first control signal provided by the first control terminal EM1 is at a low level.

Specifically in the pixel circuit above according to the embodiment of the disclosure, when the fourth transistor is turned on under the control of the first control terminal, the signal provided by the second voltage signal terminal is transmitted to an input terminal of the driving sub-circuit through the turned-on fourth transistor.

A specific structure of the first light-emission controlling sub-circuit in the pixel circuit has been described above only by way of an example, and in a specific implementation, the specific structure of the first light-emission controlling sub-circuit will not be limited to the structure above according to the embodiment of the disclosure, but can alternatively be another structure which can occur to those skilled in the art, and the embodiment of the disclosure will not be limited thereto.

In some embodiments of the disclosure, in the pixel circuit above, as illustrated in FIG. 3 and FIG. 4, the second light-emission controlling sub-circuit 5 includes a fifth transistor T5.

The fifth transistor T5 has a gate connected with the first control terminal EM1, a first electrode connected with the output terminal of the driving sub-circuit 3, and a second electrode connected with the anode of the light-emitting element OLED.

In a specific implementation, as illustrated in FIG. 3 and FIG. 4, the fifth transistor T5 can be a P-type transistor, and in this way, the fifth transistor T5 is turned on when a first control signal provided by the first control terminal EM1 is at a low level, and turned off when the first control signal provided by the first control terminal EM1 is at a high level; or the fifth transistor T5 can be an N-type transistor (not illustrated), and in this way, the fifth transistor T5 is turned on when the first control signal provided by the first control terminal EM1 is at a high level, and turned off when the first control signal provided by the first control terminal EM1 is at a low level.

Specifically in the pixel circuit above according to the embodiment of the disclosure, when the fifth transistor is turned on under the control of the first control terminal, the signal of the output terminal of the driving sub-circuit is provided to the anode of the light-emitting element OLED through the turned-on fifth transistor.

A specific structure of the second light-emission controlling sub-circuit in the pixel circuit has been described above only by way of an example, and in a specific implementation, the specific structure of the second light-emission controlling sub-circuit will not be limited to the structure above according to the embodiment of the disclosure, but can alternatively be another structure which can occur to those skilled in the art, and the embodiment of the disclosure will not be limited thereto.

In some embodiments of the disclosure, in the pixel circuit above, as illustrated in FIG. 3 and FIG. 4, the anode potential controlling sub-circuit 6 includes a sixth transistor T6.

The sixth transistor T6 has a gate connected with the second control terminal EM2, a first electrode connected with the first voltage signal terminal V1, and a second electrode connected with the anode of the light-emitting element OLED.

In a specific implementation, as illustrated in FIG. 3 and FIG. 4, the sixth transistor T6 can be a P-type transistor, and in this way, the sixth transistor T6 is turned on when a second control signal provided by the second control terminal EM2 is at a low level, and turned off when the second control signal provided by the second control terminal EM2 is at a high level; or the sixth transistor T6 can be an N-type transistor (not illustrated), and in this way, the sixth transistor T6 is turned on when the second control signal provided by the second control terminal EM2 is at a high level, and turned off when the second control signal provided by the second control terminal EM2 is at a low level.

Specifically in the pixel circuit above according to the embodiment of the disclosure, when the sixth transistor is turned on under the control of the second control terminal, the signal of the first voltage signal terminal is provided to the anode of the light-emitting element through the turned-on sixth transistor.

A specific structure of the anode potential controlling sub-circuit in the pixel circuit has been described above only by way of an example, and in a specific implementation, the specific structure of the anode potential controlling sub-circuit will not be limited to the structure above according to the embodiment of the disclosure, but can alternatively be another structure which can occur to those skilled in the art, and the embodiment of the disclosure will not be limited thereto.

In some embodiments of the disclosure, in the pixel circuit above, as illustrated in FIG. 2, the capacitor sub-circuit 7 includes a first capacitor C1.

The first capacitor C1 has one terminal connected with the second voltage signal terminal V2, and the other terminal connected with the control terminal of the driving sub-circuit 3.

Figure 5:
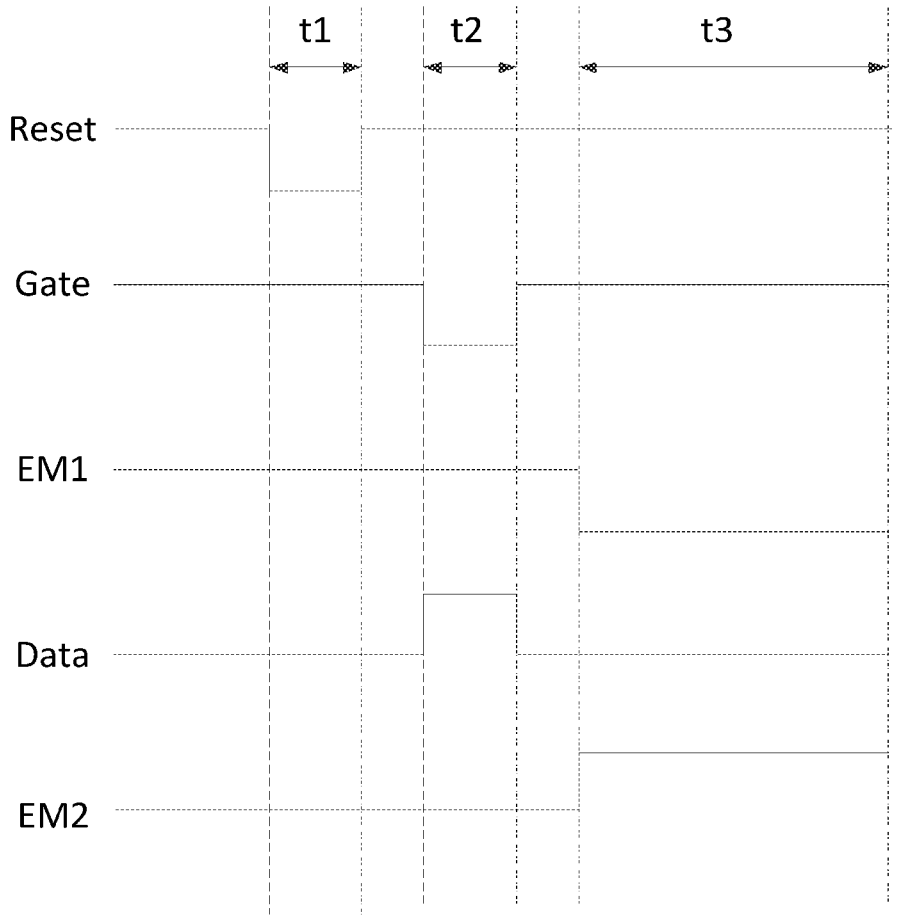
FIG. 5 is a first schematic timing diagram of the pixel circuit in FIG. 3.
Figure 6:
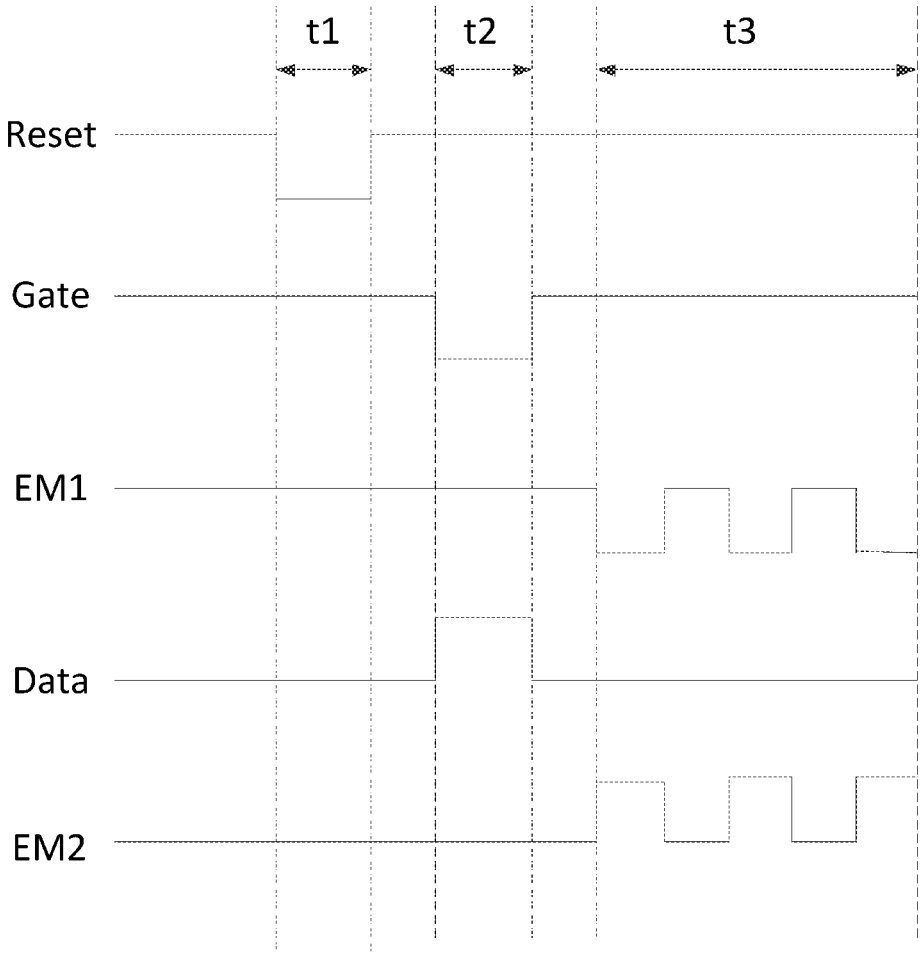
FIG. 6 is a second schematic timing diagram of the pixel circuit in FIG. 3.

In some embodiments of the disclosure, in the pixel circuit above, as illustrated in FIG. 5 and FIG. 6, the signal of the first control terminal EM1, and the signal of the second control terminal EM2 are signals with an adjustable duty cycle.

Specifically in the pixel circuit above according to the embodiment of the disclosure, the duty cycle of the signal of the first control terminal EM1 is adjusted to thereby adjust a period of time for which the OLED emits light, so as to adjust the luminance of the light-emitting element OLED. As illustrated in FIG. 5, the duty cycle of the signal of the first control terminal EM1 is 100%, the light-emitting element OLED emits light for the longest period of time, and the luminance of the light-emitting element OLED is the highest, in the period t3; and as illustrated in FIG. 6, the duty cycle of the signal of the first control terminal EM1 is 50% in the period t3, and the light-emitting element OLED emits light for a half of the period t3 so that the luminance of the light-emitting element OLED is lowered. Since the phase of the signal of the second control terminal EM2 is opposite to the phase of the signal of the first control terminal EM1 all the time, the duty cycle of the signal of the second control terminal EM2 is also adjustable in the period t3.

In order to guarantee a secured journey, a vehicular product shall be provided with a luminance adjusting function, that is, the luminance of a display panel shall be raised in a bright environment, and lowered in a dark environment to thereby avoid interference so as to guarantee the security of traveling. Of course, the pixel circuit above according to the embodiment of the disclosure can also be applicable to another display or a mobile device as needed in reality, although the embodiment of the disclosure will not be limited thereto.

In some embodiments of the disclosure, in the pixel circuit above, all the transistors are N-type transistors, or all the transistors are P-type transistors, although the embodiment of the disclosure will not be limited thereto.

In some embodiments of the disclosure, all the transistors mentioned in the pixel circuit above can be P-type transistors to thereby simplify a flow of a process of fabricating the pixel circuit.

It shall be noted that the embodiment of the disclosure has been described by way of an example in which the driver transistor is a P-type transistor, but the driver transistor can alternatively be an N-type transistor under a similar principle without departing from the claimed scope of the disclosure.

In a specific implementation, the driver transistor and the transistors can be Thin Film Transistors (TFTs), or can be Metal Oxide Semiconductor Field-Effect Transistors (MOSFETs), although the embodiment of the disclosure will not be limited thereto. In a specific implementation, the first electrodes and the second electrodes of these transistors can be sources or drains of the transistors, and their functions can be swapped dependent upon different types and input signals of the transistors, so the first electrodes and the second electrodes will not be distinguished from each other.

An operating process of the pixel circuit according to the embodiment of the disclosure will be described below taking the pixel circuit as illustrated in FIG. 3 as an example. In the following description, 1 represents a high-level signal, and 0 represents a low-level signal.

In the pixel circuit as illustrated in FIG. 3, the driver transistor DT1 and all the transistors are P-type transistors, and the respective P-type transistors are turned on at a low level, and turned off at a high level; and FIG. 5 and FIG. 6 illustrates corresponding input timing diagrams thereof.

First Embodiment

Specifically there are three selected periods t1, t2, and t3 in the input timing diagram as illustrated in FIG. 5.

In the period t1, Reset=0, Gate=1, EM1=1, Data=0, and EM2=0.

With Reset=0, the first transistor T1 is turned on to provide the signal of the first voltage signal terminal V1 to the first node N1, to thereby reset the potential at the first node N1. With EM2=0, the sixth transistor T6 is turned on to provide the signal of the first voltage signal terminal V1 to the anode of the light-emitting element OLED, to reset the potential at the anode of the light-emitting element OLED.

In the period t2, Reset=1, Gate=0, EM1=1, Data=1, and EM2=0.

With Gate=0, the second transistor T2 and the third transistor T3 are turned on, so the second transistor T2 is turned on to provide the potential at the first node N1 to the third node N3, and the third transistor T3 is turned on to provide the data signal Vdata of the data signal terminal Data to the second node N2. When Vgs of the driver transistor is higher than Vgd of the driver transistor, the driver transistor DT1 is turned on, and current flows from the second node N2 to the third node N3; and when the voltage at the third node N3 is Vdata+Vth, the driver transistor DT1 is turned off, thus resulting stable Vth of the third transistor T3, where Vgs is the voltage difference between the gate and the source of the driver transistor DT1, and Vgd is the voltage difference between the gate and the drain of the driver transistor DT1.

In this period, with EM2=0, the sixth transistor T6 is turned on to provide the signal of the first voltage signal terminal V1 to the anode of the light-emitting element OLED, and since valid voltage (i.e., voltage for turning on the sixth transistor) provided by the first voltage signal terminal V1 is lower than the voltage at the third voltage signal terminal V3, the light-emitting element is reverse-biased.

In the period t3, Reset=1, Gate=1, EM1=0, Data=0, and EM2=1.

With EM1=0, the fourth transistor T4 and the fifth transistor T5 are turned on, so the signal of the second voltage signal terminal V2 is provided to the second node N2 through the turned-on the fourth transistor T4, to turn on the driver transistor DT1 to thereby produce driving current, and the driving signal of the third node N3 is provided to the anode of the light-emitting element OLED through the turned-on fifth transistor T5; and since the voltage at the second voltage signal terminal V2 is higher than the voltage at the third voltage signal terminal V3, the light-emitting element OLED is forward-biased, and emits light.

As can be apparent from the three periods above, the light-emitting element OLED is forward-biased in the period t3 (the light-emission period), and reverse-biased in all the other periods, thus avoiding the light-emitting element OLED from being one bias state all the time, so no ions will be aggregated in the light-emitting element OLED, thus improving the light-emission efficiency and the service lifetime of the light-emitting element OLED.

Second Embodiment

Specifically there are three selected periods t1, t2, and t3 in the input timing diagram as illustrated in FIG. 6.

The three periods in this embodiment are different from those in the first embodiment in that the duty cycle of the control signal transmitted from the first control terminal EM1 in the period t3 is less than the duty cycle of the control signal transmitted from the first control terminal EM1 in the period t3 in the first embodiment, and the duty cycle of the control signal transmitted from the first control terminal EM1 is adjusted to thereby shorten a period of time for which the light-emitting element OLED emits light, so as to adjust the luminance of the light-emitting element OLED. Since the signal of the second control terminal EM2 is opposite in phase to the signal of the first control terminal EM1 all the time, the duty cycle of the signal of the second control terminal EM2 is adjustable with the duty cycle of the signal of the first control terminal EM1 to thereby avoid ions from being aggregated in the light-emitting element OLED.

Other than the different signals of the first control signal terminal and the second control signal terminal in the period t3 from those in the first embodiment, the remaining process is the same as that in the first embodiment, so reference can be made to the specific process in the first embodiment for an implementation thereof, and a repeated description thereof will be omitted here.

Figure 7:
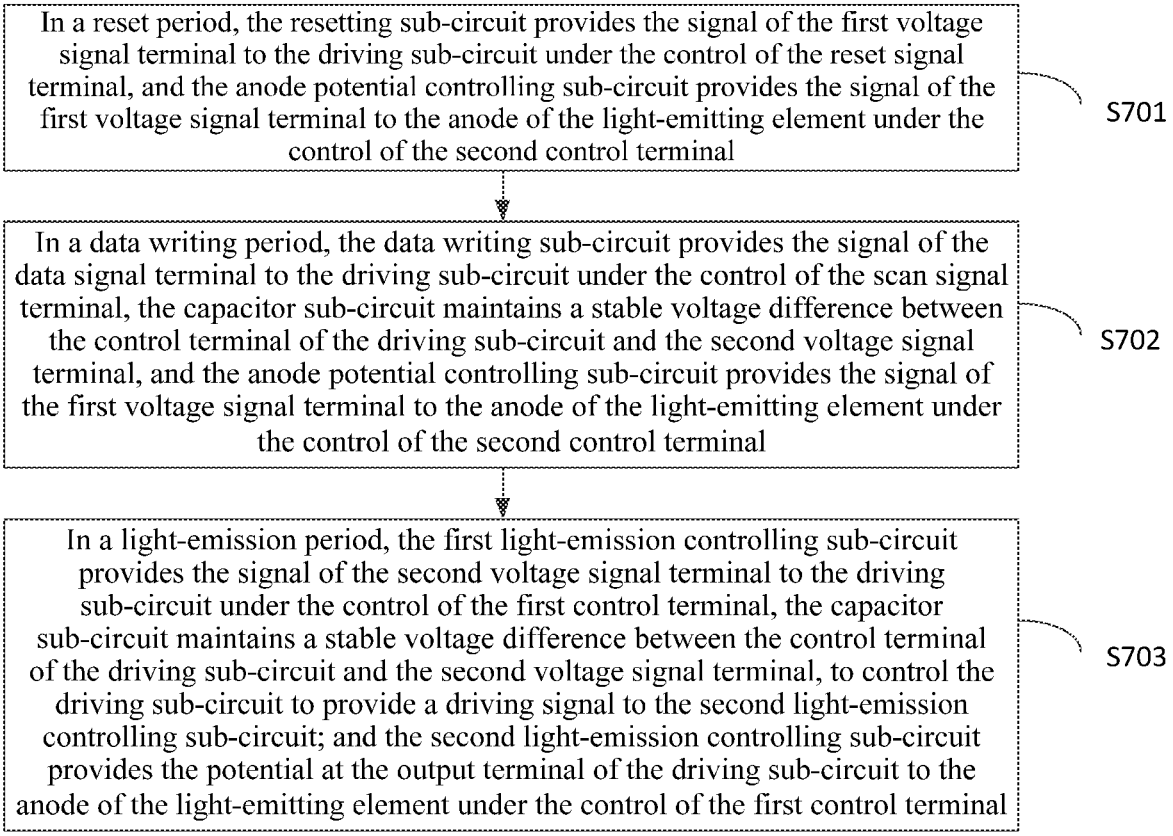
FIG. 7 is a schematic flow chart of a method for driving the pixel circuit according to an embodiment of the disclosure.

Based upon the same inventive idea, an embodiment of the disclosure further provides a method for driving the pixel circuit above, and as illustrated in FIG. 7, the method includes the following steps.

In S701, in a reset period, the resetting sub-circuit provides the signal of the first voltage signal terminal to the driving sub-circuit under the control of the reset signal terminal, and the anode potential controlling sub-circuit provides the signal of the first voltage signal terminal to the anode of the light-emitting element under the control of the second control terminal.

In S702, in a data writing period, the data writing sub-circuit provides the signal of the data signal terminal to the driving sub-circuit under the control of the scan signal terminal, the capacitor sub-circuit maintains a stable voltage difference between the control terminal of the driving sub-circuit and the second voltage signal terminal, and the anode potential controlling sub-circuit provides the signal of the first voltage signal terminal to the anode of the light-emitting element under the control of the second control terminal.

In S703, in a light-emission period, the first light-emission controlling sub-circuit provides the signal of the second voltage signal terminal to the driving sub-circuit under the control of the first control terminal, the capacitor sub-circuit maintains a stable voltage difference between the control terminal of the driving sub-circuit and the second voltage signal terminal, to control the driving sub-circuit to provide a driving signal to the second light-emission controlling sub-circuit; and the second light-emission controlling sub-circuit provides the potential at the output terminal of the driving sub-circuit to the anode of the light-emitting element under the control of the first control terminal.

In some embodiments of the disclosure, in the method above for driving a pixel circuit, the signal of the first control terminal and the signal of the second control terminal are signals with adjustable duty cycles.

FIG. 5 and FIG. 6 illustrate timing diagrams of the method for driving a pixel circuit, where the period t1 is the reset period, the period t2 is the data writing period, and the period t3 is the light-emission period; and reference can be made to the description above of the pixel circuit with reference to FIG. 5 and FIG. 6 for a specific operating principle thereof, so a repeated description hereof will be omitted here.

Based upon the same inventive idea, an embodiment of the disclosure further provides a light-emitting diode display panel including a plurality of pixel circuits according to the embodiment of the disclosure, which are arranged in a matrix. Since the light-emitting diode display panel addresses the problem under a similar principle to the pixel circuit above, reference can be made to the implementation of the pixel circuit above according to the embodiment of the disclosure for an implementation of the pixel circuits in the light-emitting diode display panel, so a repeated description hereof will be omitted here.

Based upon the same inventive idea, an embodiment of the disclosure further provides a display device including the light-emitting diode display panel above according to the embodiment of the disclosure. The display device can be a display, a mobile phone, a TV set, a notebook computer, electronic paper, a digital photo frame, a navigator, an all-in computer, etc., and all the other components indispensable to the display device shall readily occur to those ordinarily skilled in the art, so a repeated description hereof will be omitted here, and the embodiment of the disclosure will not be limited thereto.

In the pixel circuit, the method for driving the same, the display panel, and the display device above according to the embodiments of the disclosure, the pixel circuit includes: a resetting sub-circuit, a data writing sub-circuit, a driving sub-circuit, a first light-emission controlling sub-circuit, a second light-emission controlling sub-circuit, an anode potential controlling sub-circuit, a capacitor sub-circuit, and a light-emitting element, all of which operate in cooperation so that the pixel circuit drives the light-emitting element to emit light, where the second light-emission controlling sub-circuit provides voltage at an output terminal of the driving sub-circuit to an anode of the light-emitting element in a light-emission period, and the anode potential controlling sub-circuit provides a signal of a first voltage signal terminal to the anode of the light-emitting element in non-light-emission period, so that the bias of the light-emitting element is opposite to the light-emission period to thereby avoid ions from being aggregated in the light-emitting element so as to improve the light-emission efficiency and the service lifetime of the light-emitting element.

Evidently those skilled in the art can make various modifications and variations to the disclosure without departing from the spirit and scope of the disclosure. Thus the disclosure is also intended to encompass these modifications and variations thereto so long as the modifications and variations come into the scope of the claims appended to the disclosure and their equivalents.

The invention claimed is:

1. A pixel circuit, comprising: a resetting sub-circuit, a data writing sub-circuit, a driving sub-circuit, a first light-emission controlling sub-circuit, a second light-emission controlling sub-circuit, an anode potential controlling sub-circuit, a capacitor sub-circuit, and a light-emitting element, wherein:

the resetting sub-circuit is configured to provide a signal of a first voltage signal terminal to a control terminal of the driving sub-circuit under the control of a reset signal terminal;

the data writing sub-circuit is configured to provide a data signal transmitted from a data signal terminal to the driving sub-circuit under the control of a scan signal terminal;

the driving sub-circuit is configured to drive the light-emitting element to emit light, under the control of a potential at an output terminal of the resetting sub-circuit;

the first light-emission controlling sub-circuit is configured to provide a signal of a second voltage signal terminal to the driving sub-circuit under the control of a first control terminal;

the capacitor sub-circuit is configured to maintain a stable voltage difference between the second voltage signal terminal and the control terminal of the driving sub-circuit;

the second light-emission controlling sub-circuit is configured to provide voltage at an output terminal of the driving sub-circuit to an anode of the light-emitting element under the control of the first control terminal; and the anode potential controlling sub-circuit is configured to provide the signal of the first voltage signal terminal to the anode of the light-emitting element under the control of a second control terminal, wherein the anode potential controlling sub-circuit comprises a sixth transistor, and wherein the sixth transistor has a gate connected with the second control terminal, a first electrode connected with the first voltage signal terminal, and a second electrode connected with the anode of the light-emitting element;

wherein in a light-emission period, the second light-emission controlling sub-circuit provides the voltage at the output terminal of the driving sub-circuit to the anode of the light-emitting element under the control of the first control signal terminal; and in a non-light-emission period, the sixth switch transistor is turned on under the control of the second control terminal, and provides the signal of the first voltage signal terminal to the anode of the light-emitting element;

wherein the second control terminal is a different terminal from the scan signal terminal, and a signal of the first control terminal and a signal of the second control terminal are opposite level signals in phase.

2. The pixel circuit according to claim 1, wherein the resetting sub-circuit comprises a first transistor, wherein:

the first transistor has a gate connected with the reset signal terminal, a first electrode connected with the first voltage signal terminal, and a second electrode connected with the control terminal of the driving sub-circuit.

3. The pixel circuit according to claim 1, wherein the driving sub-circuit comprises: a driver transistor and a second transistor, wherein:

the driver transistor has a gate connected with the output terminal of the resetting sub-circuit, a first electrode connected with an output terminal of the first light-emission controlling sub-circuit, and a second electrode connected with an input terminal of the second light-emission controlling sub-circuit; and the second transistor has a gate connected with the scan signal terminal, a first electrode connected with the output terminal of the reset sub-circuit, and a second electrode connected with the input terminal of the second light-emission controlling sub-circuit.

4. The pixel circuit according to claim 1, wherein the data writing sub-circuit comprises a third transistor, wherein:

the third transistor has a gate connected with the scan signal terminal, a first electrode connected with the data signal terminal, and a second electrode connected with an input terminal of the driving sub-circuit.

5. The pixel circuit according to claim 1, wherein the data writing sub-circuit comprises a third transistor, wherein;

the third transistor has a gate connected with the scan signal terminal, a first electrode connected with the data signal terminal, and a second electrode connected with the control terminal of the driving sub-circuit.

6. The pixel circuit according to claim 1, wherein the first light-emission controlling sub-circuit comprises a fourth transistor, wherein:

the fourth transistor has a gate connected with the first control terminal, a first electrode connected with the second voltage signal terminal, and a second electrode connected with an input terminal of the driving sub-circuit.

7. The pixel circuit according to claim 1, wherein the second light-emission controlling sub-circuit comprises a fifth transistor, wherein:

the fifth transistor has a gate connected with the first control terminal, a first electrode connected with the output terminal of the driving sub-circuit, and a second electrode connected with the anode of the light-emitting element.

8. The pixel circuit according to claim 1, wherein the capacitor sub-circuit comprises a first capacitor, wherein:

the first capacitor has one terminal connected with the second voltage signal terminal, and the other terminal connected with the control terminal of the driving sub-circuit.

9. The pixel circuit according to claim 1, wherein the signal of the first control terminal and the signal of the second control terminal are signals with adjustable duty cycles.

10. The pixel circuit according to claim 2, wherein all the transistors are N-type transistors, or all the transistors are P-type transistors.

11. A method for driving the pixel circuit according to claim 1, comprising:

in a reset period, providing, by the resetting sub-circuit, the signal of the first voltage signal terminal to the driving sub-circuit under the control of the reset signal terminal, and providing, by the anode potential controlling sub-circuit, the signal of the first voltage signal terminal to the anode of the light-emitting element under the control of the second control terminal;

in a data writing period, providing, by the data writing sub-circuit, the signal of the data signal terminal to the driving sub-circuit under the control of the scan signal terminal, maintaining, by the capacitor sub-circuit, a stable voltage difference between the control terminal of the driving sub-circuit and the second voltage signal terminal, and providing, by the anode potential controlling sub-circuit, the signal of the first voltage signal terminal to the anode of the light-emitting element under the control of the second control terminal; and in a light-emission period, providing, by the first light-emission controlling sub-circuit, the signal of the second voltage signal terminal to the driving sub-circuit under the control of the first control terminal, maintaining, by the capacitor sub-circuit, a stable voltage difference between the control terminal of the driving sub-circuit and the second voltage signal terminal, to control the driving sub-circuit to provide a driving signal to the second light-emission controlling sub-circuit; and providing, by the second light-emission controlling sub-circuit, the potential at the output terminal of the driving sub-circuit to the anode of the light-emitting element under the control of the first control terminal.

12. The method for driving the pixel circuit according to claim 11, wherein in the light-emission period, a signal of the first control terminal and a signal of the second control terminal are signals with adjustable duty cycles.

13. A light-emitting diode display panel, comprising a plurality of pixel circuits according to claim 1, which are arranged in a matrix.

14. A display device, comprising the light-emitting diode display panel according to claim 13.

* * * * *